United States Patent [19]

Chang

[11] 4,085,913

[45] Apr. 25, 1978

[54] DEVICE FOR PREVENTING COLLISION OF TRAINS

[76] Inventor: Chen-Kun Chang, 3733 Quintara St., San Francisco, Calif. 94116

[21] Appl. No.: 758,560

[22] Filed: Jan. 12, 1977

[51] Int. Cl.[2] ..... B61L 1/08

[52] U.S. Cl. ..... 246/63 A; 104/149; 246/74; 246/182 B; 246/187 B

[58] Field of Search ..... 104/148 R, 149, 152, 104/153; 191/2, 4; 246/62, 63 R, 63 A, 63 C, 64, 67, 72, 73, 74, 167 R, 182 R, 182 B, 187 R, 187 B, 187 C

[56] References Cited

U.S. PATENT DOCUMENTS

| | | | |
|---|---|---|---|
| 1,648,527 | 11/1927 | Wyant | 246/74 X |
| 1,686,434 | 10/1928 | Bushnell | 246/63 A |
| 1,865,278 | 9/1932 | Rosenthal | 104/153 X |
| 1,877,555 | 9/1932 | Bushnell | 246/63 A |
| 2,291,372 | 7/1942 | Bushnell | 246/63 A |
| 2,554,056 | 5/1951 | Peter et al. | 246/63 A |
| 3,253,143 | 5/1966 | Hughson | 246/187 B |
| 3,272,980 | 8/1966 | Freeman | 246/63 A |
| 3,410,996 | 12/1968 | Carrino | 246/63 A |
| 3,700,886 | 10/1972 | Birkin | 246/63 A |
| 3,710,100 | 1/1973 | Perry | 246/63 C X |
| 3,790,780 | 2/1974 | Helmcke et al. | 246/63 A |

FOREIGN PATENT DOCUMENTS

| | | | |
|---|---|---|---|
| 956,722 | 10/1974 | United Kingdom | 246/63 A |

*Primary Examiner*—Stephen G. Kunin

[57] ABSTRACT

A device for preventing collision of trains includes two units, a stationary signal sending unit mounted on the wayside and a moving control unit mounted on the locomotive. The signal sending unit including the traffic light system transmits a D. C. voltage, zero, positive, or negative value, representing red, yellow, or green traffic light, to the control unit through two contacts, one mounted on the wayside and one mounted on the locomotive. The control unit includes an electro-responsive valve, the air brake system of the train, and four speed-switches. The electro-responsive valve is connected by a pipe to the air brake system of the train. Openings of the electro-responsive valve will cause brake applications. The so organized device will cause the train to stop if the train runs through a red traffic light, and will cause the train to restrict its run under a pre-set low speed limit after passing the red traffic light. It will also cause the train to slow down if the train's speed is higher than the pre-set speed limit when passing a yellow traffic light. A green traffic light will cause the device to reset itself to a non-activated state.

5 Claims, 1 Drawing Figure

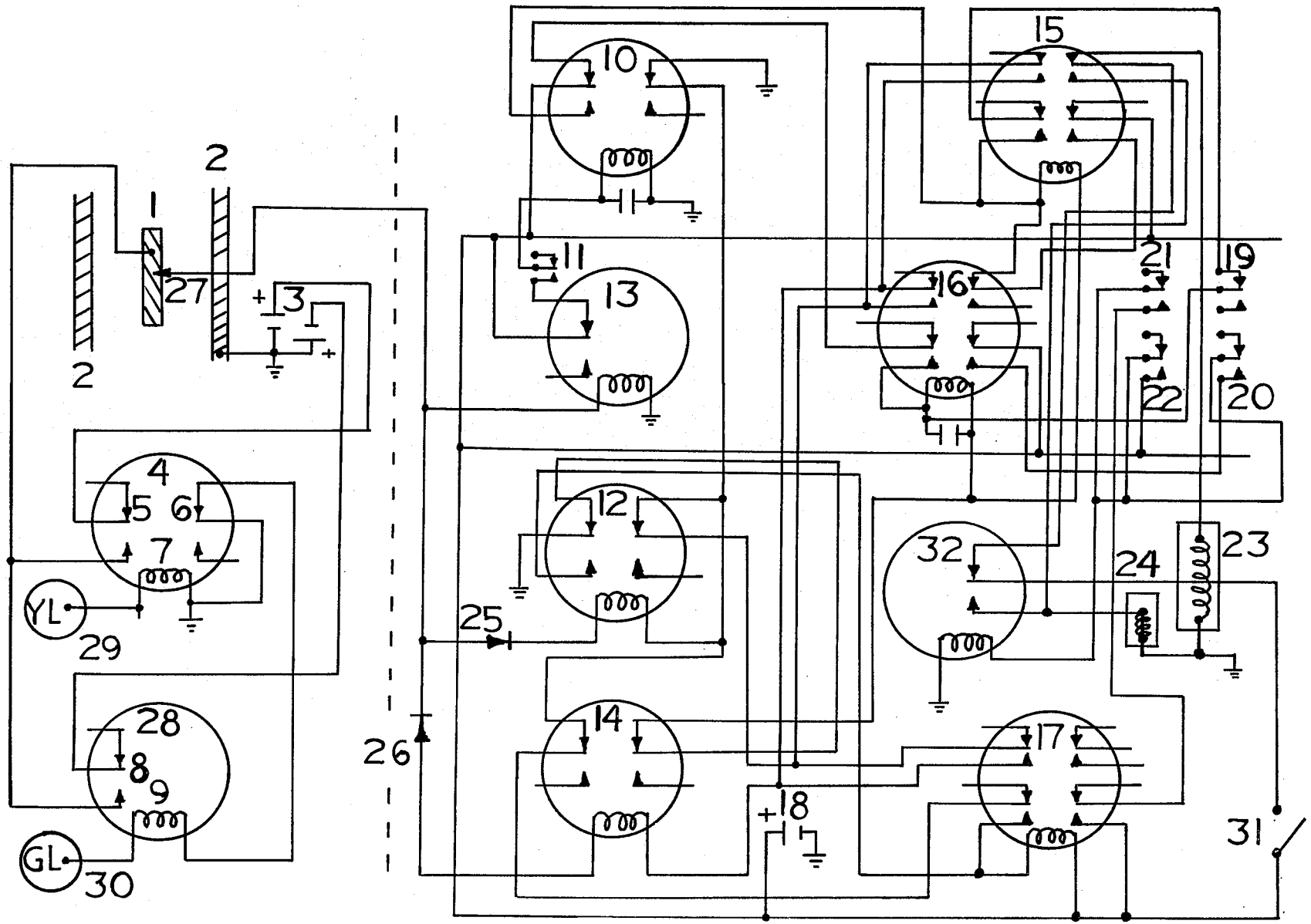
10
11
12
13
14
15
16
17
18
19
20
21
22
23
24
25
26
27
28
29
30
31
32
2
2
3
4
5
6
7
8
9
YL
GL

DEVICE FOR PREVENTING COLLISION OF TRAINS

BACKGROUND OF THE INVENTION

My invention is in the field of collision preventing for trains. My intention is to control the trains automaticly to follow the traffic lights, so collisions can be prevented. Briefly, the inventions in this field can be grouped into four categories. First category includes those inventions employing high frequency signals transmitted from the wayside to the locomotive to express red, yellow and green traffic lights. The second category includes those inventions using the two track rails as communication cables between two trains. The third category includes those inventions applying high frequency space signals to communicate between two trains or between trains and stations. The fourth category includes those inventions employing D. C. voltages transmitted from the wayside to the locomotive.

The first invention in the first category found in the U.S. patent publications was by Bushnell. He employed two inductances, one placed on the wayside and one placed on the locomotive, the signals can be transmitted from the wayside to the locomotive by interinduction between the two inductances. This invention was improved later by himself, Peter et al., Freeman, Horeezky and others. The main disadvantage of those inventions in this category is that the high frequency space signals transmitted from the wayside to the locomotive, may be easily interfered with by other space signals. The interference may cause the frequency of the signals transmitted to the locomotive to shift. Such frequency shift may result in a wrong expression of the traffic lights. The frequency expressing a red traffic light may be shifted to the frequency expressing yellow or green traffic light. This may cause the train to run on a red traffic light and to collide with another train on the way. A typical example in the second category was the invention of Carrino, Lardennois et al.. One requirement in their invention was to insulate electrically the axles from the wheels, so the two track rails will not have a short circuit caused by the axles. This kind of insulation is almost impossible, besides, the axles should not be insulated from the wheels so, the axles plus the two rails can become a part of a circuit for other purposes. An example in the third category was the invention of Helmoke et al., Schonbrodt and Listing. They invented some device similar to radio transmitters and receivers to be installed on the locomotive, which could measure the distance of approaching trains. This kind of device will be very costly and also will have the problem of interference. Also, the distance measured by the device will not be accurate when the rail way truck curves. Finally, there are two examples in the fourth category. They are the inventions of Wyant and Rosenthal. They invented devices to transmit a D. C. voltage of positive or zero value from the wayside to the locomotive. My invention can be classified into the fourth category. I employ D. C. voltages of zero, positive and negative values to represent red, yellow and green traffic lights.

BRIEF SUMMARY OF THE INVENTION

The idea of this invention was originated by the fact that many train collisions still exist in the world today. The purpose of this invention is to stop the collisions, i.e., head on or rear end collisions. The devices in this invention were designed under the assumption that most collisions were caused by those train conductors who violate traffic lights or regulations. It is also assumed that on an one-way track a train can run again under a low speed limit after a short stop for the red traffic light. In my invention, the three traffic lights, red, yellow, and green are represented by D. C. voltages of zero, positive and negative values, respectively. The D. C. voltages are transmitted through two members of conductors, one mounted on the locomotive called a conductor bar, and one mounted on the ground in the middle of the track, paralleled to the two rails called a conductor rail. When the train reaches the location where the conductor bar and the conductor rail contact, the control unit mounted on the locomotive will be activated and take a necessary action, the action will be dependent on the traffic light. For a red light, the control unit will cause to stop the train. After passing the red traffic light, the control unit will restrict the train to run under a pre-set low speed limit, say 15 km/hr. This can avoid head on or rear end collisions. For a yellow light, the control unit will be activated and check the speed of the train. If the speed is higher than a preset speed limit, say 65 km/hr, the control unit will cause to slow down the train until the speed is below the limit. For a green light, the control unit will be deactivated if it had been activated by red or yellow light previously. Normally, if the speed of the train is higher than a pre-set speed limit (different for different trains), the control unit will be activated and cause to slow down the train until the speed is under the limit. When the traffic light system or the signal sending unit is out of order, the control unit will receive a zero voltage when the conductor bar and conductor rail contact. The control unit will treat the case as if it was a red light and stop the train. When the electric source of the control unit is out of order, the electro-responsive valve will be kept open and the air pressure in the air brake system will not be built up and the train can not be run.

BRIEF DESCRIPTION OF THE DRAWING

In the accompanying diagram, the left hand section of the dashed line, except part 27, is the signal sending unit mounted on the wayside, and the right hand section is the control unit mounted on the locomotive. The signal sending unit consists of two relays 4 and 28, yellow light 29, green light 30, a conductor rail 1, two track rails 2, and two batteries 3.

The control unit consists of eight relays, 10, 12, 13, 14, 15, 16, 17, and 32, two rectifiers 25, and 26, a mechanical switch 11, a hand switch 31, a battery 18, a bell 24, an electro-responsive valve 23, a zero-speed switch 19, a low-speed switch 20, a medium-speed switch 21, a high-speed switch 22, and a conductor bar 27. Note that, relays 12, 13, and 14 can be replaced by two three-contact relays and alternated circuits with the same operations.

DETAILED DESCRIPTION OF INVENTION

This device includes two units, one mounted on the wayside called a signal sending unit and one mounted on the locomotive called a control unit. The detailed orginization and operation of these two units will be described in the following:

Signal Sending Unit

As shown in the accompanying diagram, there is no circuit connected from the signal sending unit to the red traffic light, therefore, when the traffic light is red neither relay 4 nor 28 will be energized and the D. C. voltage on 1 will be zero. When the traffic light is yellow, relay 4 will be energized and a positive voltage will be transmitted from battery 3 to contact point 5 and to 1, therefore, the voltage on 1 will be a positive value. By the same argument when the traffic light is green, relay 28 will be energized instead of relay 4, and the voltage on 1 will be a negative value instead of a positive value. Note that, here I have assigned a positive D. C. voltage to a yellow traffic light and a negative D. C. voltage to a green traffic light; I can also assign a positive D. C. voltage to a green traffic light and a negative D. C. voltage to a yellow traffic light instead.

Control Unit

Not shown in the accompanying diagram is that the electro-responsive valve 23 is connected by a pipe to the air brake system of the train. If 23 is energized the valve will close and the air pressure in the air brake can be built up, otherwise, the valve will open and the air pressure in the air brake can not be build up. So, at any time switch 31 must be on in order to energize 23 and run the train. If 31 is off 23 will not be energized and the train can not be run. When 27 and 1 contact, the voltage on 1 will be transmitted to 27 and to energize relays 13 and 12 or 13 and 14, because the voltage can be transmitted through either 25 or 26 but not both, depending on whether the traffic light is yellow or green.

The main action of the control unit is to open the electro-responsive valve at a proper time to produce brake application. For better operation, two electro-responsive valves should be used. One should be a bigger valve for producing a quick stop, and another one should be a smaller valve for producing a slow brake application to reduce the speed of the train slowly. The control unit can be considered as consisting of three independent components for treating the three traffic lights independently. The three components will be described in the following:

Red-Light Component

The main parts existing in this component are 10, 11, 13, 15, 16, 19, 20, 23, and 24. When the traffic light is red the voltage on 1 is zero, so, when 1 and 27 contact 12, 13, and 14 will not be energized, but the machanical switch 11 will be on and 10 will be energized during the time when 1 and 27 contact. The contact time must be long enough to activate a relay, which is designed to be about 0.5 second. Such contact time requires a conductor rail of about 10 meter long. Connecting a capacitor to the relay can shorten the required contact time for activating the relay. Not that, 11 can be a simple mechanical switch which will be on, when 1 and 27 contact and, off when 1 and 27 do not contact, or 11 can be a relay and the coil of the relay will be energized when 1 and 27 do not contact and will be de-energized when 1 and 27 contact. When 10 is energized 15 will be energized too and stay energized if 19 is off (speed of the train is not zero). Here, 15 will stay energized as soon as it has been activated by 10 and even after 10 has been de-energized. Then 23 will be de-energized and 24 will be energized, so the valve 23 will open and stop the train, in the mean time, the warning bell will ring.

After the train has been stopped (speed of the train being zero), 19 will be on and 16 will be energized and stay energized, and 15 will be deenergized. Here, the zero-speed switch 19 is designed in such a way that it will be on, when the speed of the train is zero and will be off, when the speed of the train is greater than zero. The other three speed switches 20, 21, and 22 are also designed in a similar way. When the speed of the train is greater than a pre-set low speed, 20 will be on, and otherwise will be off. When the speed of the train is greater than a pre-set medium speed, 21 will be on, and otherwise will be off. When the speed of the train is greater than a pre-set high speed, 22 will be on, and otherwise will be off. When 16 is energized 32 will be energized whenever 20 is on (speed of the train being greater than a pre-set value, say 15 km/hr). When 32 is energized, 23 will be de-energized and 24 will be energized. So, the valve 23 will open and slow down the train until 20 is off (the speed of the train being less than say 15 km/hr). 16 will stay to be energized unless the train meets another traffic light.

Yellow-Light Component

The main parts existing in this component are 27, 25, 12, 17, 32, 21, 23, and 24. When the traffic light is yellow, the voltage on 1 is a positive value, and the voltage will be transmitted to 27 when 27 and 1 contact. Then 13 will be energized, but 10 will not be energized. The rectifier 26 will stop the voltage to energize 14, but the rectifier 25 will allow the voltage to energize 12. After 12 is energized, 17 will be energized and stay to be energized, but 15, 16 and 32 will be de-energized if they were energized previously. After 17 has been energized 32 will be energized whenever 21 is on (the speed of the train being greater than a pre-set medium speed, say, 65 km/hr). Whenever 32 is energized, 23 will be de-energized and the train will be slowed down until 21 is off (the speed of the train being less than 65 km/hr). 17 will be de-energized if the train passes another traffic light other than yellow traffic light.

Green-Light Component

The main parts existing in this component are 27, 26, and 14. When the traffic light is green, and when 1 and 27 contact, the voltage transmitted to 27 is a negative value. The rectifier 26 will allow the voltage to energize 14. When 14 is energized, 15, 16, and 17 will be de-energized, if they were energized previously. This will reset the control unit to a non-activated state.

Note that, if the signal sending unit fails to operate for some reasons the voltage transmitted to 27 will be zero when 27 and 1 contact. The control unit will react as if it was a red traffic light and cause the train to stop. Also note that, at any time, whenever 22 is on (the speed of the train being higher than a pre-setted high speed limit), 32 will be energized and the valve 23 will open and cause the train to slow down.

It will be obvious to those skilled in the art that modifications may be in details of construction and arrangement without departing from the spirit of the invention which is not limited such matters or to matters of mere form, or otherwise than the appended claims and the prior art may require.

I claim:

1. A railway automatic signal sending unit from a wayside to a locomotive, consisting of two relays, two storage batteries, a stationary wayside contact, a yellow traffic light, a green traffic light, and electric circuits, wired such that when the yellow traffic light is on, a D. C. voltage on the stationary wayside contact is positive, when the green traffic light is on, the D. C. voltage on the stationary wayside contact is negative, and when neither the yellow nor green traffic light is on, the D. C. voltage on the stationary wayside contact is zero.

2. A railway automatic signal sending unit from a wayside to a locomotive, consisting of two relays, two storage batteries, a stationary wayside contact, a yellow traffic light, a green traffic light, and electric circuits, wired such that when the yellow traffic light is on, a D. C. voltage on the stationary wayside contact is negative, when the green traffic light is on, the D. C. voltage on the stationary wayside contact is positive, and when neither the yellow nor green traffic light is on, the D. C. voltage on the stationary wayside contact is zero.

3. A control unit mounted on a locomotive, consisting of a mechanical switch, a contact, relays, a storage battery, a zero-speed switch, a low-speed switch, an electro-responsive valve, and electric circuits, wired such that if the D. C. voltage on the contact is zero and the zero-speed switch is off and if the mechanical switch has been on for at least the time required to activate a relay, the electro-responsive valve will open and stay open until the zero-speed switch is on; and then the electro-responsive valve will open whenever the low-speed switch is on, and will close whenever the low-speed switch is off.

4. A control unit mounted on a locomotive, consisting of a mechanical switch, a contact, relays, a storage battery, a zero-speed switch, a low-speed switch, a medium-speed switch, a high-speed switch, an electro-responsive valve, and electric circuits, wired such that whenever the high-speed switch is on, the electro-responsive valve will open, and whenever the high-speed switch is off the electro-responsive valve will close, and if the D. C. voltage on the contact has been positive for at least the time required to activate a relay, the electro-responsive valve will open whenever the medium-speed switch is on, and will close whenever the medium-speed switch is off, and if the D. C. voltage on the contact has been negative for at least the time required to activate a relay, the control unit will reset itself to a non-activated state if it was activated previously, and if the D. C. voltage on the contact is zero and the zero-speed switch is off and if the mechanical switch has been on for at least the time required to activate a relay, the electro-responsive valve will open and stay open until the zero-speed switch has been on for at least the time required to activate a relay; and then the electro-responsive valve will open whenever the low-speed switch is on, and will close whenever the low-speed switch is off.

5. A control unit mounted on a locomotive, consisting of a mechanical switch, a contact, relays, a storage battery, a zero-speed switch, a low-speed switch, a medium-speed switch, a high-speed switch, an electro-responsive valve, and electric circuits, wired such that whenever the high-speed switch is on, the electro-responsive valve will open, and whenever the high-speed switch is off the electro-responsive valve will close, and if the D. C. voltage on the contact has been negative for at least the time required to activate a relay, the electro-responsive valve will open whenever the medium-speed switch is on, and will close whenever the medium-speed switch is off, and if the D. C. voltage on the contact has been positive for at least the time required to activate a relay, the control unit will reset itself to a non-activated state if it was activated previously, and if the D. C. voltage on the contact is zero and the zero-speed switch is off and if the mechanical switch has been on for at least the time required to activate a relay, the electro-responsive valve will open and stay open until the zero-speed switch has been on for at least the time required to activate a relay; and then the electro-responsive valve will open whenever the low-speed switch is on, and will close whenever the low-speed switch is off.

* * * * *